US005111552A

United States Patent [19]

Laurén et al.

[11] Patent Number: 5,111,552

[45] Date of Patent: May 12, 1992

[54] METHOD AND DEVICE FOR MANUFACTURING A MINERAL WOOL WEB

[75] Inventors: Henning J. E. Laurén; Tom E. E. Nurmi; Tapio O. Moisala, all of Pargas, Finland

[73] Assignee: Oy Partek AB, Pargas, Finland

[21] Appl. No.: 263,799

[22] PCT Filed: Apr. 24, 1987

[86] PCT No.: PCT/FI87/00054

§ 371 Date: Oct. 20, 1988

§ 102(e) Date: Oct. 20, 1988

[87] PCT Pub. No.: WO87/06631

PCT Pub. Date: Nov. 5, 1987

[30] Foreign Application Priority Data

Apr. 25, 1986 [FI] Finland ..... 861761

[51] Int. Cl.[5] ..... D01G 25/00

[52] U.S. Cl. ..... 19/308; 19/161.1; 65/4.4; 156/62.4; 156/62.8; 156/264; 156/512; 156/556; 425/83.1

[58] Field of Search ..... 156/62.2, 62.6, 62.8, 156/296, 304.1, 304.7, 256, 266, 264, 265, 270, 556, 512, 513, 521; 34/108, 115, 120; 19/161.1, 296, 301, 302, 305, 308; 264/121, 118, 109; 425/80.1, 83.1, 82.1; 65/4.4

[56] References Cited

U.S. PATENT DOCUMENTS

| | | | |
|---|---|---|---|
| 2,425,660 | 8/1947 | Ware et al. | 156/265 |
| 2,503,067 | 4/1950 | Powell | 156/62.6 |
| 2,758,630 | 8/1956 | Hodge | 156/265 |
| 2,889,583 | 6/1959 | Wacker et al. | 19/161.1 |
| 3,050,200 | 8/1962 | Siempelkamp | 198/607 |
| 3,104,191 | 9/1963 | Hicks et al. | 156/180 |
| 3,332,819 | 7/1967 | Siempelkamp | 425/80.1 |
| 4,201,247 | 5/1980 | Shannon | 156/180 |
| 5,030,312 | 7/1991 | Williams et al. | 156/264 |

FOREIGN PATENT DOCUMENTS

| | | | |
|---|---|---|---|
| 310045 | 9/1973 | Austria . | |
| 0563964 | 1/1957 | Belgium | 19/161.1 |
| 2223201 | 12/1972 | Fed. Rep. of Germany . | |
| 1396786 | 6/1976 | United Kingdom . | |

*Primary Examiner*—Michael W. Ball
*Assistant Examiner*—Steven D. Maki
*Attorney, Agent, or Firm*—Cushman, Darby & Cushman

[57] ABSTRACT

The invention relates to a method and a device for producing a mineral wool web from a thin primary web formed on a movable collecting surface (6). According to prior known methods, the primary web is folded on a receiving conveyor (18) in an overlapping configuration so that the desired thickness of web is achieved. It is also known to combine two or several primary webs and to form the final mineral wool web by folding. The problem when producing mineral wool webs is the high rate of production of the primary webs and consequently, the high requirements on the devices in the further process and a great loss of material because of uneven edges which have to be cut down.

According to the invention, the primary web is split into separate sheets before the deposit on the receiving conveyor (18), and the sheets are deposited by an oscillating distributing conveyor (16) in an overlapping configuration on the receiving conveyor, or, in case sheets are being produced, stacked on top of each other. The method offers several possibilities of reducing the feeding rate of the sheets and thus facilitating the deposit on the receiving conveyor. The flow of split sheets may for instance be separated (11, 12) into two or several flows to an intermediate conveyor each (14, 15) and the sheets may be stacked before the deposit. The cutting of the primary web may be performed on the collecting surface (6) or optionally after this on an intermediate conveyor.

42 Claims, 3 Drawing Sheets

METHOD AND DEVICE FOR MANUFACTURING A MINERAL WOOL WEB

Figure 1:
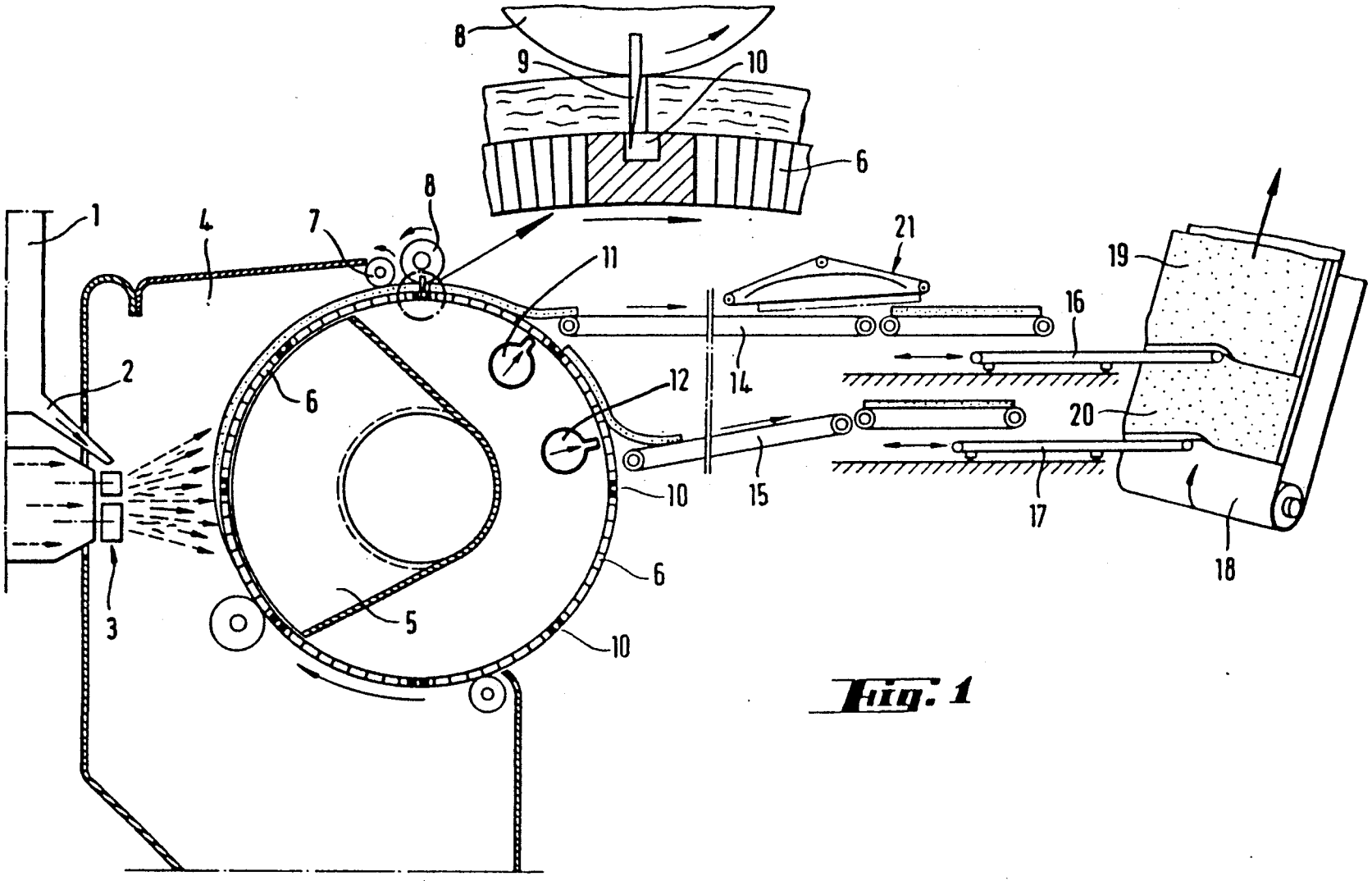

Mineral wood is a product having innumerable fields of application, of which the main field is the use as insulating material for heat and sound insulation.

Originally, mineral wood products consisted of an unorganized bundle of fibres, however, during the last 40 years they have been imparted a more or less solid shape by introducing a binding agent inbetween the fibres and by curing the composition, most frequently in the form of a mat which subsequently is sawn to the desired dimensions.

The preparation of mineral wood products is carried out by melting mineral raw materials in a furnace, such as an electric furnace or a cupola furnace. The melt is allowed to flow continuously out of the furnace to a fibration assembly, usually consisting of a range of rapidly rotating cylinders, the melt flowing against the mantle surfaces of these. As the melt strikes the rotating mantle surfaces, it adheres and gains an accelerating rate which finally leads to the melt being successively flung out under the effect of the centrifugal force, whereby droplets of the melt stretch out and form fibres. The fibres are primarily flung out in a plane normal to the axis of the fibration cylinders. The fibre flow is deflected out of this plane by means of a directed flow of gas which guides the fibre flow towards a collecting member, which may consist of a perforated conveyor belt, a net conveyor, a perforated apron conveyor or one or several perforated drums. The fibres are deposited on the surface of the collection conveyor, while the gas flow is sucked into a suction box inside the perforated collecting surface.

In a conventional collecting process, the collection of fibres takes place in one step so that the desired grammage of fibres is obtained on the collection member. The adhesive has generally been introduced by spraying a binding solution on the deflected fibre flow whereafter the fibres comprising the binder agent are guided towards the collecting member. The web with the desired grammage is subsequently lead to a tempering furnace in which the product gets the proper width and thickness, and the binder is fixed. This is followed by cooling, formatting, possible surface treatment and packing.

Achieving a product which is as regular and homogenous as possible is an important aim of the process. The regularity and homogeneity influence the insulating capacity. Another aim is to obtain a product, in which the fibres are oriented in the product plane. This gives an elastic product which can be compressed for the packing and transport step.

In order to achieve this, a relatively thin primary web is collected on the collecting surface, the grammage of which ranges from 100 to 450 g/m$^2$. Thus, the fibres get a regular and satisfactory orientation and the binder is equally distributed in the web. In order to maintain the capacity on the desired level while having a thin primary web, the rate of production of the primary web has to be high, like the rate of subsequent devices.

In known processes used up till now, the primary web is transformed by a folding process into a final web comprising zigzag folds. The folding may be performed in one or several steps and results in a final web having from 6 to 20 layers. The primary web may also be doubled before the folding. According to another known process, primary webs from several collecting members are superposed and folded simultaneously.

According to all the proceedings used until today, the primary webs obtained have always been handled as continuous coherent mats, which have been superposed by doubling, folding and/or laminating.

When folding the primary web, reversible conveyors have usually been used, feeding the primary web down between two pendulum elements, while the conveyor output ends move to and fro at a rate essentially equal to the feeding rate of the primary web, in order to avoid folding or stretching of the mat in the output step. The reversible movement has most frequently been realized by disposing the end positions of the pendulum strike highest above the receiving conveyor and the lower dead position of the pendulum closest to the receiving conveyor. (This technique appears for instance from the patent application SE 8403519-5.) There are also constructions in which the folding process is carried out in a way to deposit all the parts of the primary web right above the base, at a constant height. (Such a procedure is shown for instance in the application SE 8403520-3.)

The undesirable aspects of previously used processes are as follows:

The weight of the pendulum conveyors is relatively high, whereby the accelerating and decelerating forces cause great stress in the stands and the crank mechanisms driving the pendulums.

The oscillating surfaces of the pendulum conveyors are large and bring great masses of air into movement during their oscillation. The air resistance against these surfaces causes great mechanical stresses in the pendulum mechanism.

Since mineral wool fibres tend to float in air streams the oscillation movement of the pendulums creates substantial dust problems.

The edges of the final web comprise folds and irregularities arising partly during the folding and caused by irregularities and irregular movements in the primary web as it leaves the reversible conveyors, in particular at the turning points. In order to obtain satisfactory end products, the edges have to be sawn over a large area, which means a loss of approximately 5 to 6%.

An additional problem is that the pendulums do not cope with the high rates of the primary web, being possibly up to 200 m/min if the grammage is 100 g/m$^2$ and the capacity must be 3 to 5 ton/h. The folding result is poor and the pendulums do not resist the dynamic stresses.

The object of the present invention is thus to achieve a method and a device by means of which the collection of a thin primary web may be performed at a rate required for yielding a desired capacity and the primary web deflected from the collecting member may be transferred to a final web without imparting the web forming process with the above undesirable.

According to the present invention, this has been achieved by separating the continuous primary web into separate sheets before depositing it on the receiving conveyor, where the final mineral wool web is formed. The sheets are deposited by means of an appropriate conveyor on to the receiving conveyor in an overlapping configuration so as to obtain the desired grammage. It is obvious that the problems caused by the prior known pendulum motion are totally eliminated since the deposit is done in the form of separate sheets. The folding irregularities are eliminated, and at the same time the deposit may be controlled so as to achieve completely even edges.

The splitting of the primary web into separate sheets may take place directly on the collecting surface or after this on an intermediate conveyor or between two intermediate conveyors.

When the splitting takes place on the collecting surface, a perforated drum is preferably used as the collecting surface. Alternatively, splitting may take place on plane collecting surfaces, like perforated conveyor belts of various kinds. The perforated mantle surface is supplied with counter-surfaces or grooves evenly distributed over the mantle surface and against which a cutting device is disposed to cut the primary web. The spacing of the grooves or tracks corresponds to the desired sheet length. The cutting device may be of a guillotine type or mounted onto a roll, rotating preferably in contact with the collecting drum so that the cutter strikes the drum at each groove. The drum may also have a greater diameter so that the peripheral surface corresponds e.g. to five sheet lengths and thus comprises five cutters striking the counter-surfaces of the drum.

The cutting devices and the parallel counter-surfaces on the drum are either parallel to the drum axis or form a small angle with this. In the former case, the split sheets get a square or rectangular configuration and in the latter case that of a parallelogram.

The splitting of the primary web into sheets may also take place without cutting devices, but usually a cutting device is used in order to assure a previously established partition of the web. Such a splitting process is done by preventing a fibre accumulation at the points where a splitting of the web is desired. For this purpose, the perforated web is shaped with non-perforated gaps as described above or form a small angle with this. The suction power operating inside the drum then only affects the perforated surfaces aspirating fibres to these surfaces, whereas the unperforated gaps remain essentially free of fibres.

The separation of the split sheets is done in any known manner, preferably by a forced gas exhaust. The cutting device being disposed on a roll of which the periphery corresponds to a sheet length, the sheets are continuously conveyed on the drum mantle surface, until they reach an exhaust device disposed beneath the mantle. The cutting device being disposed on a roll of which the periphery corresponds to several sheet lengths, the exhaust device may be disposed to separate sheets onto the cutting roll, from where they are separated by exhaust onto one or several intermediate conveyors, which transfer them to the receiving conveyor.

When process according to the invention is applied by carrying out the splitting after collecting surface, in view of the process direction, the cutting into sheets is performed on an intermediate conveyor or between two conveyors. The cutting device may advantageously consist of a guillotine type cutter.

Particularly when applying the process in connection with collecting on a drum, there are several possibilities of reducing the rates of the intermediate conveyors with regard to the collecting rate of the primary web, which is one of the main objects of the invention.

The separation from the drum may be arranged to take place at two or more points to an intermediate conveyor each, which one at a time transmit the sheets to the receiving conveyor. The rate of the intermediate conveyors then decreases to half or one third or one fourth of the peripheral rate of the drum. The separation may be disposed to take place by means of alternating exhaust devices.

To each intermediate conveyor, a distributing conveyor is connected, which consists of a conveyor oscillating in the horizontal plane, to which the intermediate conveyor transfers a sheet or stacked sheets and from which the same sheets are transferred onto the receiving conveyor.

The receiving conveyor preferably runs transversely to the conveying direction of the distributing conveyor, i.e. perpendicular or at a small angle to the production direction of the sheets. In the event that the direction of the receiving conveyor deviates somewhat from 90° with regard to the direction of motion of the intermediate conveyor, and the distributing conveyor the sheets advantageously have been given the configuration of a parallelogram. In this case the fibre orientation of the finished wool web is perpendicular to the fibre orientation of the primary web.

The receiving conveyor may have the same direction of motion as the distributing conveyor. The fibre orientation of the finished wool web will then coincide with the fibre orientation of the primary web.

One further manner of reducing the rate of the distributing conveyors is arranging a stacking device which piles sheets on top of each other during the conveyance from cutting to distribution. This may be done in several ways. One way is by means of a perforated conveyor mounted above an intermediate conveyor, which can suck up for instance, every second sheet momentarily, for subsequent deposit on a following sheet. Optionally, the sheet can be deposited on a preceding sheet in a device where the conveyor by revolving or moving reaches above the preceding sheet. Another method consists of conducting every second sheet over a conveyor, which again leads the sheets down to a subsequent sheet. Such stacking devices are known in the art.

By making the stacking device revolve, the fibre direction may vary in the finished web. Every second sheet may for instance turn 90°, whereby half of the sheets have a fibre orientation which is perpendicular to the fibre orientation of the other half of the sheets. This results in an extremely homogenous mineral wool web.

The process according to the invention may also be utilized for continuous production of laminated mineral wool webs. By means of one or several additional distributing conveyors, one may be in a known manner bring other sheets or layers of various materials such as net, braided glass fibre weave, and similar materials, directly onto a mineral wool sheet, whereby the different material enters the web as an overlapping sheet together with the other sheets. These different material sheets having different qualities or fibre structure than the mineral wool sheets can be used to impart new properties to the final web.

Figure 2:
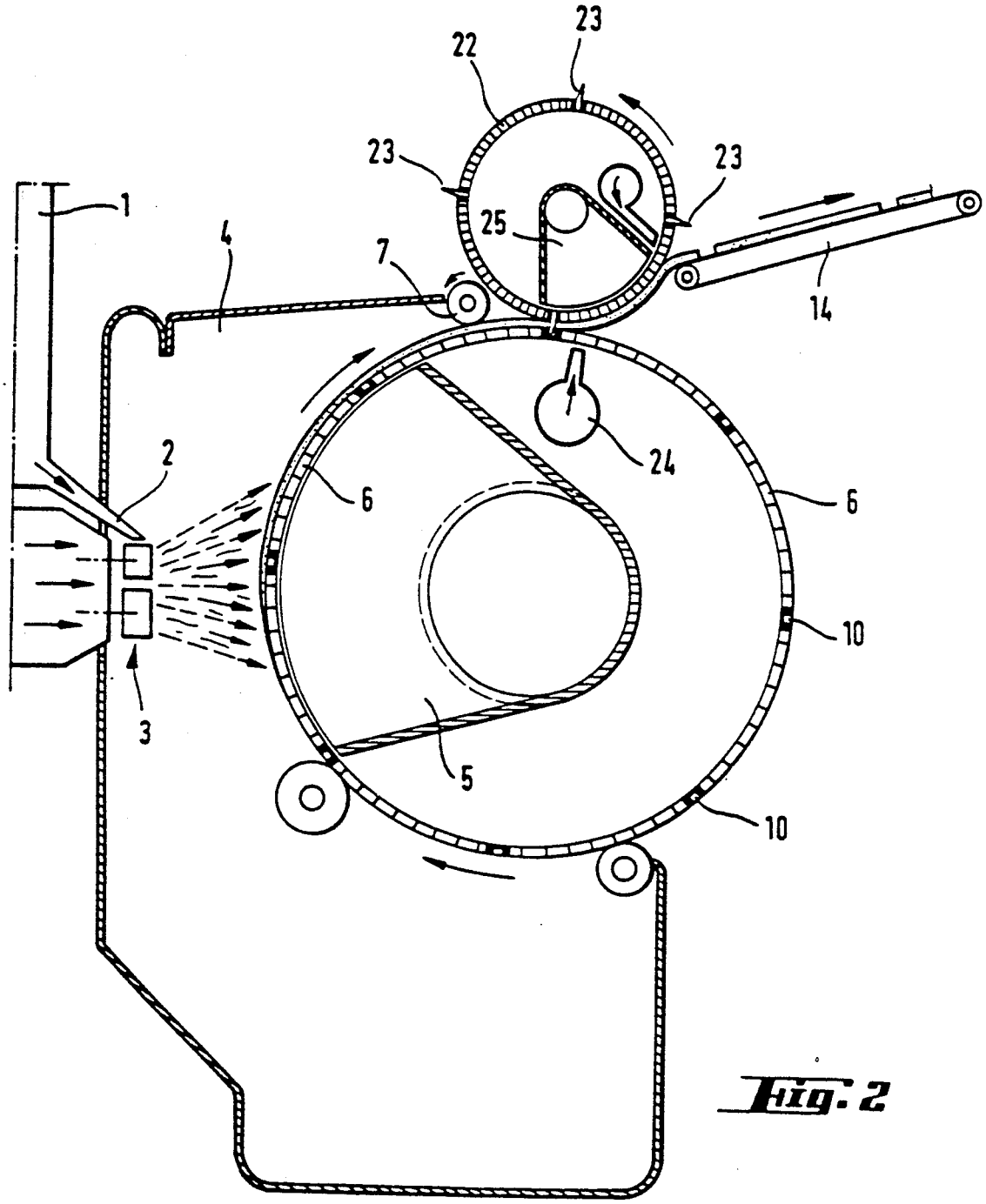
Figure 3:
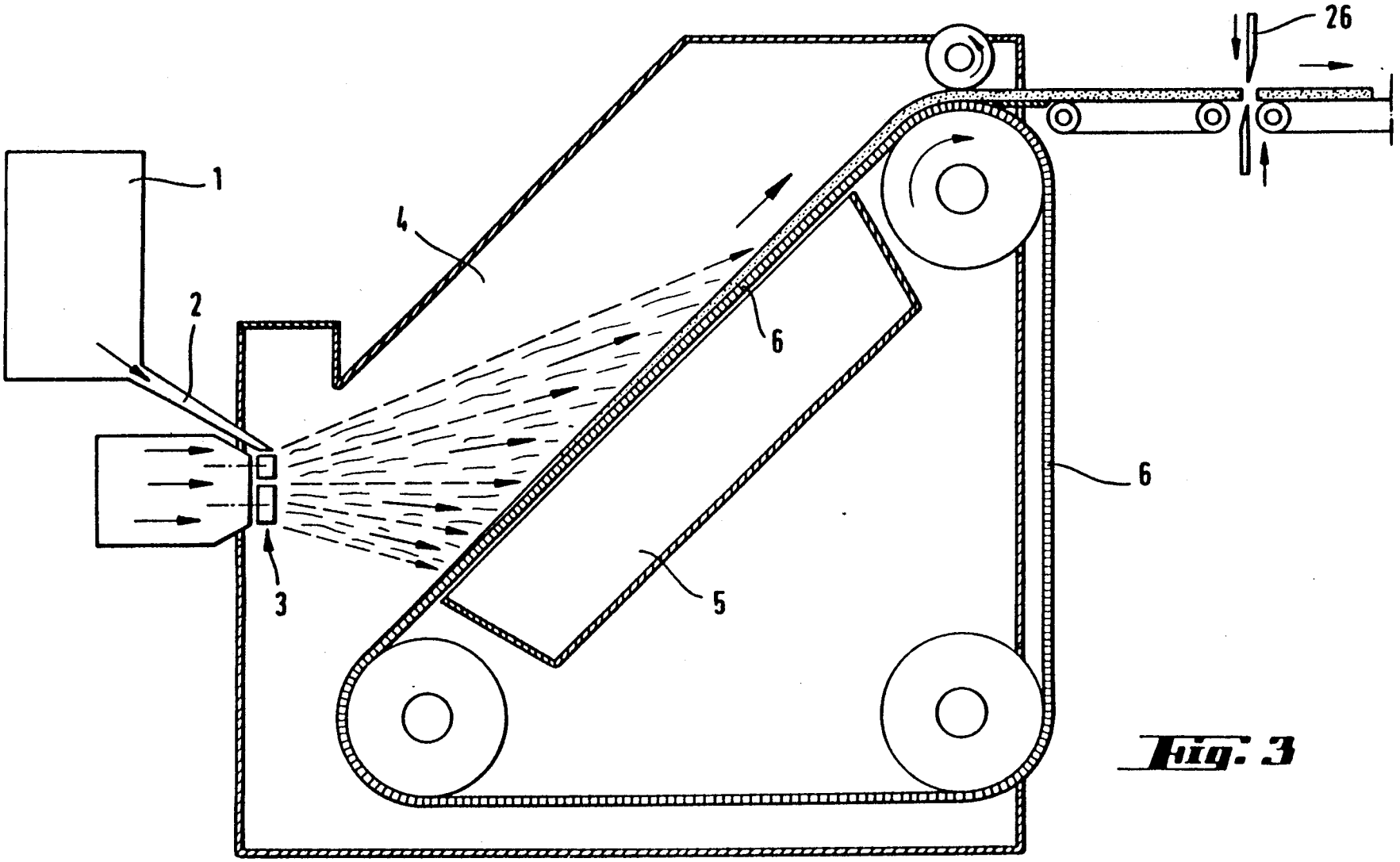

The invention will be described in detail below as preferable embodiment examples and referring to the enclosed drawings, in which FIG. 1 shows a vertical section of a device for carrying out the process according to the invention, FIG. 2 shows a modification of the device according to FIG. 1, also as a vertical section, from which the devices subsequent to the intermediate conveyor have been eliminated, and FIG. 3 shows a rough vertical section of a modification of the device according to the invention, in which the collecting surface consists of a triangular net web and in which the devices subsequent to the intermediate conveyor have been eliminated.

In the different figures the same reference numerals refer to the same matter.

Reference numeral 1 refers to a melting furnace from which the melt thereby obtained flows through a flute, indicated by the number 2, to a fibration assembly, indicated by 3. The number 4 denotes the wool chamber, 5 a suction box, which is mounted inside the collecting conveyor 6. The melt flows down on the fibration assembly, which flings melt droplets stretched to fibres by the centrifugal force. A binding agent can be applied to the fibres by one or more known binder application devices (not shown). A gas flow deflects the fibre flow towards the collecting conveyor 6, which consists of a perforated drum. The suction box fitted tight against the inner surface of the drum attracts the fibre stream, whereby the fibres are deposited on the rapidly rotating drum and form a thin primary web. The reference numeral 7 denotes a sealing device consisting of a rotating roll. The number 8 indicates another roll rotating in contact with the peripheral surface of the drum, which forms a cutting roll and thus is provided with a cutting blade 9 for cutting the primary web into separate sheets. The cutting base, i.e. the counter-surface of the cutter, is a slot or a track 10 consisting of a break in the perforation. Thus, the primary web receives an indication of fracture or a disrapture at this point. In case the track 10 only produces an indication of fracture, the cutting blade is needed to finish the cutting off of the web. If the track leads to an area in the web with no fibres adhered thereto, a disrapture of the mat, the cutting device may not be needed and is disconnected. The reference numerals 11 and 12 denote exhaust points for the primary web. They alternate continuously in operation such that a first cut off sheet is separated to an intermediate conveyor 14 and a second to another intermediate conveyor 15. The intermediate conveyors, 14 and 15, are of a conventional type. From the intermediate conveyors, the sheets are conducted to oscillating horizontal distributing conveyors 16 and 17, respectively belonging to the intermediate conveyors, 14 and 15. The distributing conveyors receive a sheet from the intermediate conveyor in their left-hand position in FIG. 1 and deposit it in their right-hand extreme position in FIG. 1 onto the receiving conveyor, indicated by 18. In this embodiment, the receiving conveyor runs transversely to the distributing conveyor, resulting in the fibre orientation of the processed continuous web being perpendicular to the fibre orientation of the primary web. The conveying rate of the intermediate conveyors 14 and 15 is the same as the rate of motion of the primary web on the drum, whereas the rate of the distributing conveyors is only half of this, since the separated sheets are fed out on two distributing conveyors. The overlapping sheets fed out on the receiving conveyor are indicated by 19 and 20. The rate of the receiving conveyor is adapted to the distribution rate of the sheets, thus obtaining the desired overlapping on the receiving conveyor, and the desired web thickness.

The reference numeral 21 indicates a stacking device which advantageously is disposed to cooperate with one of the intermediate conveyors, in this case the conveyor 14. The stacking device 21 is a perforated conveyor sucking every second sheet momentarily, and depositing it subsequently on the following sheet. The stacking device may turn, e.g. through 90°, thereby changing the fiber direction in the sheet to be normal to the general fiber direction in the sheet. Thus, the feeding rate of sheets fed out decreases and the rate of the distributing conveyor may be correspondingly reduced.

FIG. 2 shows the collecting drum 6 on which the fibre flow from the fibration assembly accumulates, and a cutting and suction roll 22 rotating in contact with the drum. The collecting drum is provided with unperforated slots resulting in fracture indications or fractures. The final separation of the sheets is ensured also in this embodiment by cutters 23. The cutters are equally spaced over the periphery of the roll 22, the distance between the cutters corresponding to a sheet length plus the length of the fracture indication. After the cutting off at the tangential point of the roll and the drum, the cut off sheet is blown off to the roll 22 by means of an exhaust device 24 and the suction box 25 installed inside the roll. The sheet is preferably separated immediately after the suction box to an intermediate conveyor, after which the continued process corresponds to the embodiment described in connection with FIG. 1. The cutting and suction roll 22 may also have a greater diameter, comprising for instance four or five cutters disposed on the mantle surface. The sheet flow is then advantageously separated to two intermediate conveyors shown in FIG. 1, to allow the rate of the distributing conveyor to be reduced.

FIG. 3 shows schematically a deposit of a fibre flow on a collecting surface having the form of a triangular net web. Having left the sealed chamber 4, the primary web is conveyed on a horizontal conveyor, on which the cutting into sheets takes place. The cutting is done by means of a cutter of guillotine type 26, a cutting roll like the ones described above, or any other appropriate prior known cutting device.

The invention is not restricted to the described embodiments, but may be modified within the limits of the following claims.

We claim:

1. A method for forming a mineral wool web from several layers of a primary web comprising the steps of:

depositing fibers on a collecting surface to form the primary web;

splitting the primary web into separate sheets;

feeding the separate sheets along at least two paths to a receiving conveyor; and depositing the separate sheets on the receiving conveyor in an overlapping manner, wherein a rate of flow of deposit of each separate path of sheets onto the receiving conveyor is less than a rate of motion of the collecting surface.

2. A method as in claim 1, wherein the depositing step comprises the step of depositing the separate sheets continuously to form a continuous mineral wool web.

3. A method as in claim 1, wherein the splitting step comprises a step of splitting the primary web before it leaves a collecting conveyor.

4. A method as in claim 1, wherein the splitting step comprises a step of splitting the primary web after it leaves a collecting conveyor.

5. A method as in claim 3, further including a step of forming fracture indications in the primary web by preventing a deposit of web forming fibres at selected splitting locations.

6. A method as in claim 4, further including a step of forming fracture indications in the primary web by preventing a deposit of web forming fibres at selected splitting locations.

7. A method as in claim 1, further including a step of separating the split sheets from a collecting conveyor with a forced gas.

8. A method as in claim 3, further including a step of separating the split sheets from the collecting conveyor with a forced gas.

9. A method as in claim 1, further including a step of transferring the separated sheets to at least one intermediate conveyor which transfers the sheets from a separation point to the receiving conveyor.

10. A method as in claim 1, further including a step of transferring the separated sheets to at least one intermediate conveyor which transfers the sheets from a separation point to the receiving conveyor.

11. A method as in claim 9, further including a step of lifting some of the sheets from the intermediate conveyor and lowering them back onto other sheets then positioned on the intermediate conveyor to stack the sheets.

12. A method as in claim 10, further including a step of lifting some of the sheets from the intermediate conveyor and lowering them back onto other sheets then positioned on the intermediate conveyor to stack the sheets.

13. A method as in claim 11, further including a step of depositing the stacked sheets on the receiving conveyor as a single sheet.

14. A method as in claim 12, further including a step of depositing the stacked sheets on the receiving conveyor as a single sheet.

15. A method as in claim 1, wherein the splitting step comprises a step of splitting the primary web against a countersurface with at least one blade.

16. A method as in claim 15, wherein the splitting step comprises a step of splitting the primary web against a countersurface by engaging the blade with at lest one inset channel in the countersurface.

17. A method as in claim 3, wherein the splitting step comprises a step of splitting the primary web along parallel lines perpendicular to the edges of the primary web.

18. A method as in claim 4, wherein the splitting step comprises a step of splitting the primary web along parallel lines perpendicular to the edges of the primary web.

19. A method as in claim 1, wherein the depositing step comprises a step of depositing the sheets on the receiving conveyor in their flow direction.

20. A method as in claim 1, further including a step of carrying away the sheets deposited on the receiving conveyor at a right angle to the oncoming flow of sheets.

21. A method as in claim 1, further including a step of turning some of the sheets before depositing them on the receiving conveyor.

22. A method as in claim 1, further including a step of turning every second sheet.

23. A method as in claim 21, wherein the turning step comprises a step of turning some of the sheets 90°.

24. A method as in claim 1, further including a step of inserting additional sheets of different compositions into the main flow of sheets.

25. A device for manufacturing a mineral wool web comprising:

a collecting surface;

means for depositing fibers on said collecting surface to form a primary web;

a device for splitting the primary web into sheets;

transfer means for conveying the sheets along at least two paths to a receiving conveyor and depositing the sheets from the separate paths in an overlapping condition onto the receiving conveyor for forming a continuous mineral wool web of a desired thickness, wherein a rate of flow of deposit of each separate path of sheets onto the receiving conveyor is less than a rate of motion of the collecting surface.

26. A device as in claim 25, wherein the transfer means comprises at least one intermediate conveyor arranged between a collecting conveyor and the receiving conveyor for guiding the split sheets from the collecting conveyor to the receiving conveyor.

27. A device as in claim 25, wherein the splitting device comprises at least one cutter attached to a rotary roller, the cutter engaging a surface of a collecting conveyor and having a periphery length equal to a required sheet length.

28. A device as in claim 27, wherein the splitting device comprises several cutters which are evenly distributed over the roller periphery in accordance with a required sheet length.

29. A device as in claim 27, wherein the roller comprises internally mounted suction means for attaching the sheets to the roller.

30. A device as in claim 27, wherein countersurfaces for at least one cutter are provided on a collecting conveyor.

31. A device as in claim 30, wherein the countersurfaces comprise inset channels for engaging the cutter.

32. A device as in claim 27, wherein the cutter engages an inset channel on a cutting countersurface.

33. A device as in claim 28, wherein each cutter engages an inset channel on a cutting countersurface.

34. A device as in claim 27, further comprising means for separating the primary web from a collecting conveyor.

35. A device as in claim 34, wherein the separating means comprises a blower for blowing forced gas.

36. A device as in claim 25, wherein the transfer means comprises at least one distribution conveyor which can be oscillated in a horizontal plane.

37. A device as in claim 26, further comprising a stacking device comprising a suction box arranged above at least one intermediate conveyor.

38. A device as in claim 37, wherein the stacking device is rotatable by 90° to 180°.

39. A device as in claim 37, wherein the stacking device comprises means for attracting and holding a first sheet by suction, then depositing it on a second sheet which has been positioned under the first sheet.

40. A device as in claim 25, further comprising preventing means for preventing the deposit of web forming fibres on a collecting conveyor to form fracture indications at selected splitting locations.

41. A device as in claim 25, wherein the splitting device comprises opposing blades.

42. A device as in claim 41, wherein the splitting device comprises means for splitting the primary web after the primary web leaves a collecting conveyor.

* * * * *